US008306456B2

(12) United States Patent
Yonemoto

(10) Patent No.: US 8,306,456 B2
(45) Date of Patent: Nov. 6, 2012

(54) BELT DEVICE AND IMAGE FORMING APPARATUS PROVIDED WITH THE SAME

(75) Inventor: Satoru Yonemoto, Osaka (JP)

(73) Assignee: Kyocera Mita Corporation (JP)

( * ) Notice: Subject to any disclaimer, the term of this patent is extended or adjusted under 35 U.S.C. 154(b) by 263 days.

(21) Appl. No.: 12/819,487

(22) Filed: Jun. 21, 2010

(65) Prior Publication Data

US 2010/0329750 A1 Dec. 30, 2010

(30) Foreign Application Priority Data

Jun. 24, 2009 (JP) ..... 2009-149891

(51) Int. Cl.
*G03G 15/08* (2006.01)

(52) U.S. Cl. ..... 399/121

(58) Field of Classification Search ..... 399/121, 399/301, 302, 308
See application file for complete search history.

(56) References Cited

U.S. PATENT DOCUMENTS

2001/0007617 A1* 7/2001 Nakamura ..... 399/298

FOREIGN PATENT DOCUMENTS

JP 2006-343629 12/2006

* cited by examiner

*Primary Examiner* — David Gray
*Assistant Examiner* — Gregory H Curran
(74) *Attorney, Agent, or Firm* — Gerald E. Hespos; Michael J. Porco

(57) ABSTRACT

A belt device is provided with an endless belt, a plurality of rollers on which the belt is mounted and including a drive roller connected to a specified drive source and rotating the belt and a belt meandering correction roller correcting the meandering of the belt in a width direction of the belt, a sensor detecting the position of an end surface of the belt in a sensor detection area divided into a plurality of zones adjacent in the belt width direction, a roller position adjusting mechanism adjusting the position of the belt meandering correction roller to correct the meandering of the belt, and a controller controlling the roller position adjusting mechanism based on the position detection of the belt end surface by the sensor, the controller controlling the roller position adjusting mechanism to keep the belt end surface in a specific one of the plurality of zones.

12 Claims, 11 Drawing Sheets

FIRST CONTROL PATTERN

FIRST CONTROL PATTERN

SECOND CONTROL PATTERN

FIG.10

| t | BELT END SURFACE POSITION | a(t) | x(t) | b(t) | c(t) | DRIVEN ROLLER POSITION |
|---|---|---|---|---|---|---|
| 0 | 1.050 | 10 | 0 | 2 | 0 | 0 |
| 4 | 1.070 | 10 | 0 | 3 | 0 | 0 |
| 8 | 1.090 | 10 | 0 | 4 | 0 | 0 |
| 12 | 1.110 | 11 | -7 | 1 | -7 | -0.14 |
| 16 | 1.102 | 11 | 0 | 2 | -7 | -0.14 |
| 20 | 1.094 | 10 | 3 | 1 | 3 | -0.08 |
| 24 | 1.098 | 10 | 0 | 2 | 3 | -0.08 |
| 28 | 1.102 | 11 | -1 | 1 | -1 | -0.1 |
| 32 | 1.102 | 11 | 0 | 2 | -1 | -0.1 |
| 36 | 1.102 | 11 | 0 | 3 | -1 | -0.1 |
| 40 | 1.102 | 11 | 0 | 4 | -1 | -0.1 |
| 44 | 1.102 | 11 | 0 | 5 | -1 | -0.1 |
| 48 | 1.102 | 11 | 0 | 6 | -1 | -0.1 |
| 52 | 1.102 | 11 | 0 | 7 | -1 | -0.1 |
| 56 | 1.102 | 11 | 0 | 8 | -1 | -0.1 |
| 60 | 1.102 | 11 | 0 | 9 | -1 | -0.1 |
| 64 | 1.102 | 11 | 0 | 10 | -1 | -0.1 |
| 68 | 1.102 | 11 | 0 | 11 | -1 | -0.1 |
| 72 | 1.102 | 11 | 0 | 12 | -1 | -0.1 |
| 76 | 1.102 | 11 | 0 | 13 | -1 | -0.1 |
| 80 | 1.102 | 11 | 0 | 14 | -1 | -0.1 |
| 84 | 1.102 | 11 | 0 | 15 | -1 | -0.1 |
| 88 | 1.102 | 11 | 0 | 16 | -1 | -0.1 |
| 92 | 1.102 | 11 | 0 | 17 | -1 | -0.1 |
| 96 | 1.102 | 11 | 0 | 18 | -1 | -0.1 |
| 100 | 1.102 | 11 | 0 | 19 | -1 | -0.1 |
| 104 | 1.102 | 11 | 0 | 20 | -1 | -0.1 |
| 108 | 1.102 | 11 | 0 | 21 | -1 | -0.1 |
| 112 | 1.102 | 11 | 0 | 22 | -1 | -0.1 |
| 116 | 1.102 | 11 | 0 | 23 | -1 | -0.1 |
| 120 | 1.102 | 11 | 0 | 24 | -1 | -0.1 |
| 124 | 1.102 | 11 | 0 | 25 | -1 | -0.1 |
| 128 | 1.102 | 11 | 0 | 26 | -1 | -0.1 |
| 132 | 1.102 | 11 | 0 | 27 | -1 | -0.1 |
| 136 | 1.102 | 11 | 0 | 28 | -1 | -0.1 |
| 140 | 1.102 | 11 | 0 | 29 | -1 | -0.1 |
| 144 | 1.102 | 11 | 0 | 30 | -1 | -0.1 |
| 148 | 1.102 | 11 | 0 | 31 | -1 | -0.1 |
| 152 | 1.102 | 11 | 0 | 32 | -1 | -0.1 |
| 156 | 1.102 | 11 | 0 | 33 | -1 | -0.1 |
| 160 | 1.102 | 11 | 0 | 34 | -1 | -0.1 |
| 164 | 1.102 | 11 | 0 | 35 | -1 | -0.1 |
| 168 | 1.102 | 11 | 0 | 36 | -1 | -0.1 |
| 172 | 1.102 | 11 | 0 | 37 | -1 | -0.1 |
| 176 | 1.102 | 11 | 0 | 38 | -1 | -0.1 |
| 180 | 1.102 | 11 | 0 | 39 | -1 | -0.1 |
| 184 | 1.102 | 11 | 0 | 40 | -1 | -0.1 |
| 188 | 1.102 | 11 | 0 | 41 | -1 | -0.1 |
| 192 | 1.102 | 11 | 0 | 42 | -1 | -0.1 |
| 196 | 1.102 | 11 | 0 | 43 | -1 | -0.1 |
| 200 | 1.102 | 11 | 0 | 44 | -1 | -0.1 |

FIG.12

| t | BELT END SURFACE POSITION | a(t) | x(t) | b(t) | c(t) | DRIVEN ROLLER POSITION |
|---|---|---|---|---|---|---|
| 0 | 0.990 | 9 | 0 | 2 | 0 | 0 |
| 4 | 1.120 | 11 | -38 | 1 | -25 | -0.76 |
| 8 | 1.098 | 10 | 13 | 1 | 13 | -0.5 |
| 12 | 1.128 | 11 | -7 | 1 | -7 | -0.66 |
| 16 | 1.130 | 11 | 0 | 2 | -7 | -0.66 |
| 20 | 1.132 | 11 | 0 | 3 | -7 | -0.66 |
| 24 | 1.134 | 11 | 0 | 4 | -7 | -0.66 |
| 28 | 1.136 | 11 | 0 | 5 | -7 | -0.66 |
| 32 | 1.138 | 11 | 0 | 6 | -7 | -0.66 |
| 36 | 1.140 | 11 | 0 | 7 | -7 | -0.66 |
| 40 | 1.142 | 11 | 0 | 8 | -7 | -0.66 |
| 44 | 1.144 | 11 | 0 | 9 | -7 | -0.66 |
| 48 | 1.146 | 11 | 0 | 10 | -7 | -0.66 |
| 52 | 1.148 | 11 | 0 | 11 | -7 | -0.66 |
| 56 | 1.150 | 11 | 0 | 12 | -7 | -0.66 |
| 60 | 1.152 | 11 | 0 | 13 | -7 | -0.66 |
| 64 | 1.154 | 11 | 0 | 14 | -7 | -0.66 |
| 68 | 1.156 | 11 | 0 | 15 | -7 | -0.66 |
| 72 | 1.158 | 11 | 0 | 16 | -7 | -0.66 |
| 76 | 1.160 | 11 | 0 | 17 | -7 | -0.66 |
| 80 | 1.162 | 11 | 0 | 18 | -7 | -0.66 |
| 84 | 1.164 | 11 | 0 | 19 | -7 | -0.66 |
| 88 | 1.166 | 11 | 0 | 20 | -7 | -0.66 |
| 92 | 1.168 | 11 | 0 | 21 | -7 | -0.66 |
| 96 | 1.170 | 11 | 0 | 22 | -7 | -0.66 |
| 100 | 1.172 | 11 | 0 | 23 | -7 | -0.66 |
| 104 | 1.174 | 11 | 0 | 24 | -7 | -0.66 |
| 108 | 1.176 | 11 | 0 | 25 | -7 | -0.66 |
| 112 | 1.178 | 11 | 0 | 26 | -7 | -0.66 |
| 116 | 1.180 | 11 | 0 | 27 | -7 | -0.66 |
| 120 | 1.182 | 11 | 0 | 28 | -7 | -0.66 |
| 124 | 1.184 | 11 | 0 | 29 | -7 | -0.66 |
| 128 | 1.186 | 11 | 0 | 30 | -7 | -0.66 |
| 132 | 1.188 | 11 | 0 | 31 | -7 | -0.66 |
| 136 | 1.190 | 11 | 0 | 32 | -7 | -0.66 |
| 140 | 1.192 | 11 | 0 | 33 | -7 | -0.66 |
| 144 | 1.194 | 11 | 0 | 34 | -7 | -0.66 |
| 148 | 1.196 | 11 | 0 | 35 | -7 | -0.66 |
| 152 | 1.198 | 11 | 0 | 36 | -7 | -0.66 |
| 156 | 1.200 | 12 | -1 | 1 | -1 | -0.64 |
| 160 | 1.198 | 11 | 0 | 2 | -1 | -0.64 |
| 164 | 1.196 | 11 | 0 | 3 | -1 | -0.64 |
| 168 | 1.194 | 11 | 0 | 4 | -1 | -0.64 |
| 172 | 1.192 | 11 | 0 | 5 | -1 | -0.64 |
| 176 | 1.190 | 11 | 0 | 6 | -1 | -0.64 |
| 180 | 1.188 | 11 | 0 | 7 | -1 | -0.64 |
| 184 | 1.186 | 11 | 0 | 8 | -1 | -0.64 |
| 188 | 1.184 | 11 | 0 | 9 | -1 | -0.64 |
| 192 | 1.182 | 11 | 0 | 10 | -1 | -0.64 |
| 196 | 1.180 | 11 | 0 | 11 | -1 | -0.64 |
| 200 | 1.178 | 11 | 0 | 12 | -1 | -0.64 |

BELT DEVICE AND IMAGE FORMING APPARATUS PROVIDED WITH THE SAME

BACKGROUND OF THE INVENTION

1. Field of the Invention

The present invention relates to a belt device including a transfer belt for carrying, for example, a toner image and an image forming apparatus provided with the same.

2. Description of the Related Art

An image forming apparatus such as a printer, a facsimile machine or a copier includes, as main constituent elements, a photosensitive drum on which a toner image is to be formed based on image information from the outside, a belt device including a transfer belt to which a toner image is to be transferred from the photosensitive drum, a transfer unit for transferring a toner image on the transfer belt to a recording medium such as a sheet and a fixing unit for fixing a toner image on a sheet to the sheet.

A belt device generally includes a drive roller connected to a specified drive source, a plurality of driven rollers and a transfer belt mounted on these rollers. The transfer belt has a toner image transferred from the photosensitive drum while being driven and rotated as the drive roller is rotated.

In the belt device, the transfer belt may move in a belt width direction to meander or to be shifted toward one side during the rotation. If the transfer belt meanders or is shifted toward one side, the positions of color toner images are displaced from each other upon transferring a plurality of color toner images one over another to the transfer belt, which causes color drift. As a result, it becomes difficult to form a high-quality image.

In order to solve such an inconvenience, the meandering or shift of the belt needs to be corrected. A first prior art is known as such a technology. A belt device of the first prior art includes a contact element which comes into contact with a widthwise end surface of a transfer belt and pivots according to the position of the belt end surface, a displacement sensor for detecting a distance to the contact element, a meandering corrector for correcting the widthwise meandering of the transfer belt by adjusting the inclination of one (meandering correction roller) of a plurality of rollers on which a transfer belt is mounted and moving the transfer belt in a width direction, and a controller for controlling the meandering corrector based on a detection signal from the displacement sensor.

In the belt device constructed as above, the position of the belt end surface in the width direction is detected based on the detection signal from the displacement sensor and the controller controls the meandering corrector and adjusts the inclination of the meandering correction roller, thereby executing a control until the position of the belt end surface in the width direction reaches one reference position. In the first prior art, the meandering of the transfer belt is corrected by such a control.

However, in the belt device of the first prior art, it is necessary to continuously move the transfer belt in a specified forward or reverse direction with respect to the reference position until the position of the belt end surface in the width direction reaches the reference position. Thus, it takes time to correct the meandering of the transfer belt.

SUMMARY OF THE INVENTION

Accordingly, in view of the above situation, it is an object of the present invention to provide a belt device capable of quickly correcting the meandering of a transfer belt and an image forming apparatus provided with the same.

In order to accomplish the above object, one aspect of the present invention is directed to a belt device, comprising an endless belt, a plurality of rollers on which the belt is mounted and including a drive roller connected to a specified drive source and rotating the belt and a belt meandering correction roller correcting the meandering of the belt in a width direction of the belt, a sensor detecting the position of an end surface of the belt in a sensor detection area divided into a plurality of zones adjacent in the belt width direction, a roller position adjusting mechanism adjusting the position of the belt meandering correction roller to correct the meandering of the belt, and a controller controlling the roller position adjusting mechanism based on the position detection of the belt end surface by the sensor, the controller controlling the roller position adjusting mechanism to keep the belt end surface in a specific one of the plurality of zones.

BRIEF DESCRIPTION OF THE DRAWINGS

FIG. 10 is a table showing belt end surface position and other values, which changed with time, based on FIG. 9.

FIG. 12 is a table showing belt end surface position and other values, which changed with time, based on FIG. 11.

DETAILED DESCRIPTION OF THE PREFERRED EMBODIMENTS

Figure 1:
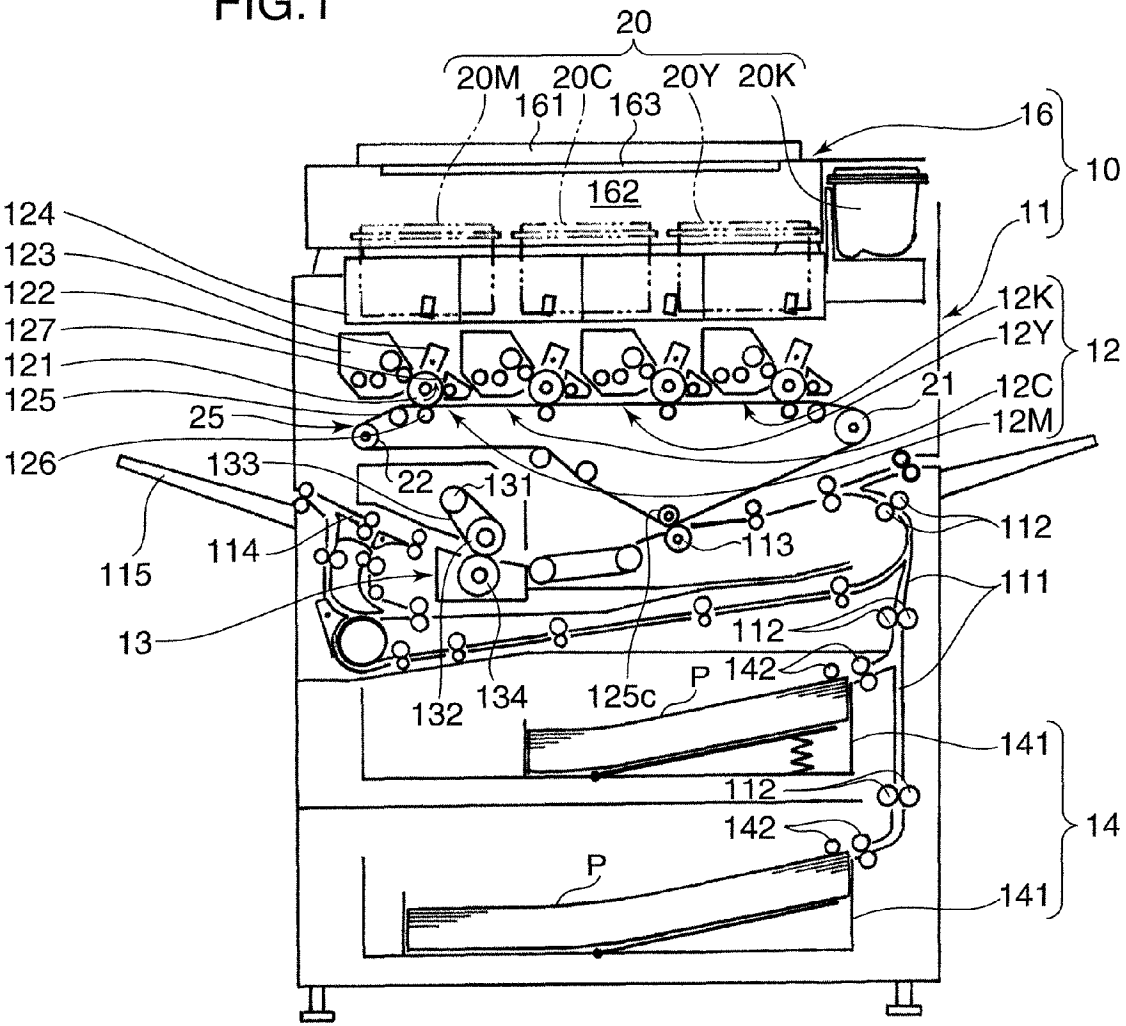
FIG. 1 is a front sectional view showing an exemplary internal construction of an image forming apparatus employing a belt device according to one embodiment.

First of all, an image forming apparatus including a belt device according to one embodiment of the present invention is outlined with reference to FIG. 1. FIG. 1 is a front sectional view showing an exemplary internal construction of the image forming apparatus. The image forming apparatus 10 is used as a copier for color printing and includes, as a basic construction, a box-shaped apparatus main body 11 and an image reader 16 arranged in an upper part of the apparatus main body 11 for reading a document image.

The apparatus main body 11 houses an image forming unit 12 for forming an image based on image information of a document read by the image reader 16, a fixing unit 13 for fixing an image formed by the image forming unit 12 and transferred to a sheet P and a sheet storage unit 14 for storing sheets P.

The image reader 16 includes a document presser 161 openably and closably provided on the upper surface of the apparatus main body 11 and an optical unit 162 arranged to face the document presser 161 via a contact glass 163 in the upper part of the apparatus main body 11. The contact glass 163 is so dimensioned as to have a planar shape slightly smaller than the document presser 161 for reading a document surface of a placed document. The document presser 161 is opened and closed by being rotated in forward and reverse directions about a specified shaft at one side of the upper surface of the apparatus main body 11 as one constituent element of the image reader 16.

The optical unit 162 includes unillustrated light source, plural mirrors, lens unit, CCD (charge coupled device). Light from the light source is reflected by a document surface and this reflected light is input to the CCD as document information via these mirrors and lens unit. The document information in the form of an analog quantity input to the CCD is stored in a specified storage device after being converted into a digital signal.

The image forming unit 12 is for forming toner images on a sheet P fed from the sheet storage unit 14 and includes a magenta unit 12M, a cyan unit 12C, a yellow unit 12Y and a black unit 12K successively arranged from an upstream side (left side in the plane of FIG. 1) toward a downstream side. Each of the units 12M, 12C, 12Y and 12K includes a photosensitive drum 121 and a developing device 122. Each photosensitive drum 121 receives the supply of toner from the corresponding developing device 122 while being rotated in a counterclockwise direction in FIG. 1. Toner containers 20 are arranged on the front side (front side of the plane of FIG. 1) and the right side of FIG. 1 in correspondence with the respective developing devices 122, and toners are supplied to the developing devices 122 from the toner containers 20.

The magenta toner container 20M, the cyan toner container 20C, the yellow toner container 20Y and the black toner container 20K for supplying the toners of the respective colors to the corresponding developing devices 122 of the magenta to black units 12M, 12C, 12Y and 12K are detachably mounted in the apparatus main body 11 above the image forming unit 12.

A charger 123 is arranged right above each photosensitive drum 121. An exposure device 124 is arranged above the chargers 123 and the developing devices 122. Each photosensitive drum 121 has a circumferential surface thereof uniformly charged by the corresponding charger 123. The charged circumferential surfaces of the photosensitive drums 121 are radiated with laser beams from the exposure device 124 corresponding to the respective colors based on image data input by the image reader 16. In this way, electrostatic latent images are formed on the circumferential surfaces of the photosensitive drums 121. The toners of the respective colors are supplied from the developing devices 122 to the electrostatic latent images, whereby toner images are formed on the circumferential surfaces of the photosensitive drums 121.

A belt device 25 according to this embodiment is arranged below the image forming unit 12. The belt device 25 includes a transfer belt 125 disposed below the photosensitive drums 121, a drive roller 21 connected to a drive source (FIG. 3) and adapted to drive and rotate the transfer belt 125, and a driven roller group composed of a driven roller 22, a secondary-transfer opposed roller 125*c*, etc. The transfer belt 125 is an endless belt so mounted on the drive roller 21, the driven roller 22, the secondary-transfer opposed roller 125*c* and other necessary rollers as to be held in contact with the circumferential surfaces of the respective photosensitive drums 121. The belt device 25 also includes primary transfer rollers 126 disposed in correspondence with the respective photosensitive drums 121. The transfer belt 125 is rotated clockwise between the drive roller 21 and the driven roller 22 in synchronization with the respective photosensitive drums 121 while being pressed against the circumferential surfaces of the photosensitive drums 121 by the primary transfer rollers 126. A detailed construction of the belt device 25 is described later.

As the transfer belt 125 is rotated, a magenta toner image formed on the photosensitive drum 121 of the magenta unit 12M is first transferred to the outer surface of the transfer belt 125. Subsequently, a cyan toner image formed on the photosensitive drum 121 of the cyan unit 12C is transferred in a superimposition manner to the transfer position of the magenta toner image on the transfer belt 125. Similarly, a yellow toner image formed by the yellow unit 12Y and a black toner image formed by the black unit 12K are successively transferred in a superimposition manner thereafter. In this way, a color toner image is formed on the outer surface of the transfer belt 125. The color toner image formed on the outer surface of the transfer belt 125 is transferred to a sheet P conveyed form the sheet storage unit 14.

A cleaner 127 for cleaning the circumferential surface of the photosensitive drum 121 by removing the residual toner therefrom is disposed to the right of each photosensitive drum 121 in FIG. 1. The circumferential surface of the photosensitive drum 121 cleaned by the cleaner 127 is charged again by the charger 123. The waste toner removed from the circumferential surface of the photosensitive drum 121 by the cleaner 127 is collected into an unillustrated toner collection bottle via a specified path.

The sheet storage unit 14 for storing sheets P is arranged in the bottommost part of the apparatus main body 11. The sheet storage unit 14 includes detachable sheet trays 141 for storing stacks of sheets P. Although the sheet trays 141 are arranged in two levels in the example shown in FIG. 1, they may be arranged in three or more levels or in a single level.

A sheet conveyance path 111 for conveying sheets P from the sheet storage unit 14 is arranged between the image forming unit 12 and the sheet storage unit 14. The sheet conveyance path 111 extends from a position to the right of the sheet storage unit 14 to a position below the image forming unit 12. Conveyor roller pairs 112 are disposed at specified positions in the sheet conveyance path 111. Further, a secondary transfer roller 113 in contact with the outer surface of the transfer belt 125 is disposed in the sheet conveyance path 111 at a position facing the secondary-transfer opposed roller 125*c* of the belt device 25.

Sheets P are dispensed one by one from the sheet trays 141 by the driving of pickup rollers 142. The dispensed sheet P is conveyed toward a nip between the secondary transfer roller 113 and the transfer belt 125 via the sheet conveyance path 111 by the driving of the conveyor roller pairs 112. In the nip, a color toner image transferred to the outer surface of the transfer belt 125 is transferred to the sheet P.

The fixing unit 13 is for fixing a toner image on a sheet P transferred in the image forming unit 12. The fixing unit 13 includes a heating roller 131 internally provided with an electrical heating element such as a halogen heater as a heat source, a fixing roller 132 arranged to face the heating roller 131, a fixing belt 133 mounted between the fixing roller 132 and the heating roller 131, and a pressure roller 134 arranged to face the fixing roller 132 via the fixing belt 133. A sheet P finished with the fixing process and bearing a toner image is discharged toward a discharge tray 115 provided on the left wall of the apparatus main body 11 via a discharge conveyance path 114 extending from a position above the fixing unit 13.

Figure 2:
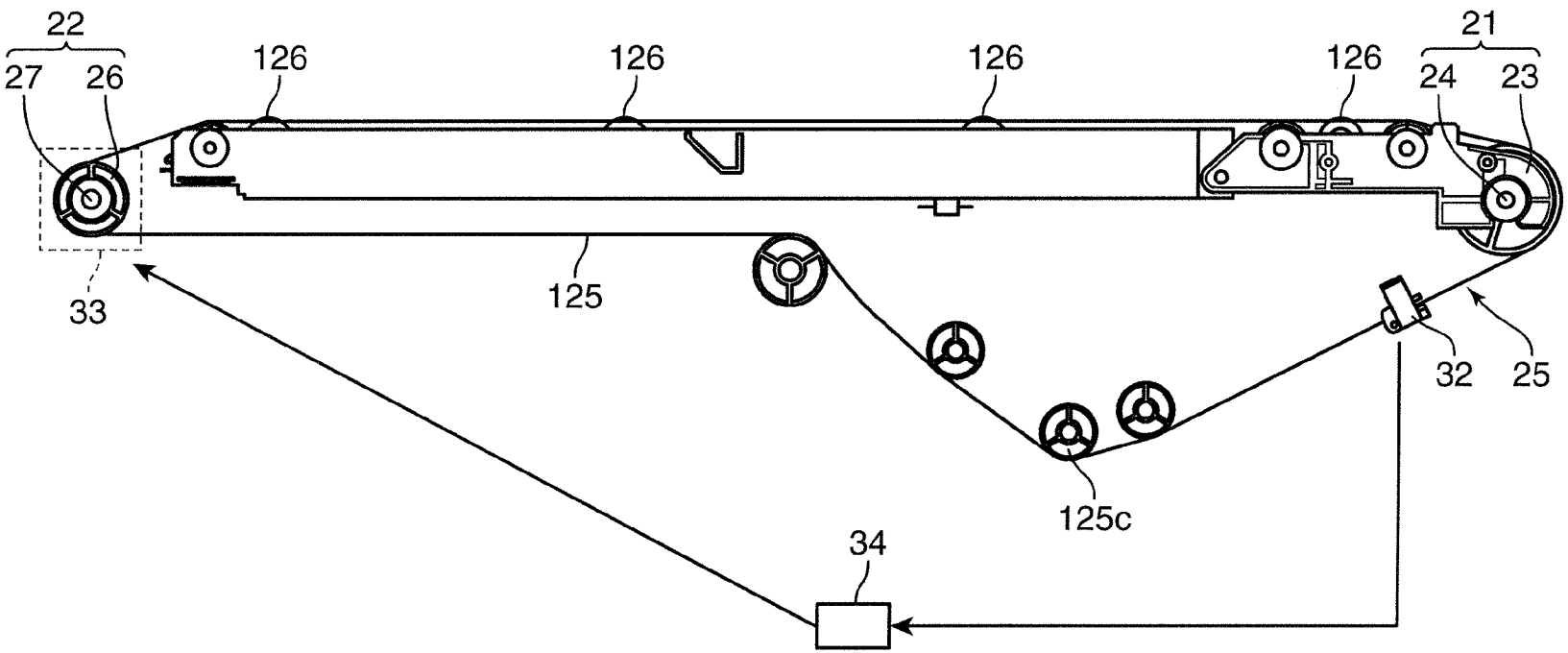
FIG. 2 is an enlarged view of the belt device shown in FIG. 1.

The belt device 25 according to this embodiment is described below. FIG. 2 is an enlarged view of the belt device shown in FIG. 1. As described above, the belt device 25 includes, as basic constituent elements, the drive roller 21 and the driven roller group composed of the driven roller 22, the primary transfer rollers 126, the secondary-transfer opposed roller 125*c* and the like, and the transfer belt 125 mounted on these rollers. The drive roller 21 includes a first roller body 23 and a first rotary shaft 24 (FIG. 3) coaxial with and integrally rotatably supporting the first roller body 23. The driven roller 22 includes a second roller body 26 and a second rotary shaft 27 (FIG. 4) coaxial with and integrally rotatably supporting the second roller body 26. The drive roller 21 and the driven roller 22 are arranged to face in a longitudinal direction of the transfer belt 125 with the first and second rotary shafts 24, 27 set in parallel with each other.

Figure 3:
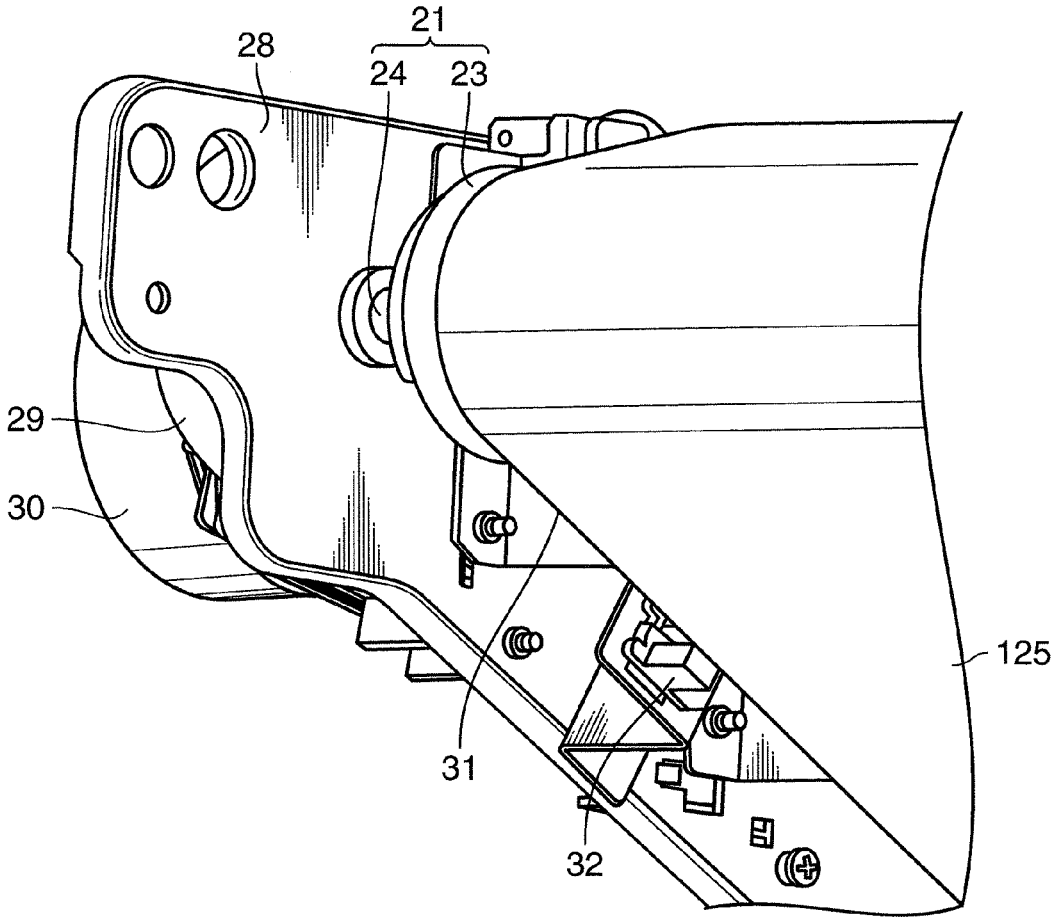
FIG. 3 is a perspective view showing a drive roller of the belt device and its periphery.

The first rotary shaft 24 is rotatably supported on a specified supporting frame 28 as shown in FIG. 3. A gear 29 is so mounted on a part of the first rotary shaft 24 projecting from the supporting frame 28 as to be coaxial with the first rotary shaft 24. The gear 29 is engaged with an output shaft of a drive source, e.g. a motor 30. Thus, when the motor 30 is driven to rotate the output shaft, the gear 29 is rotated. Since the first rotary shaft 24, i.e. the drive roller 21 is rotated as the gear 29 is rotated, the transfer belt 125 is driven and rotated. At this time, the driven roller 22 is driven and rotated as described above.

In the belt device 25 constructed as above, while being rotated, the transfer belt 125 may move in a belt width direction to meander or be shifted toward one side. If the meandering or shift of the transfer belt 125 occurs, the positions of toner images are displaced from each other to cause color drift when the toner images are transferred in a superimposition manner on the transfer belt 125 from the respective photosensitive drums 121 of the magenta unit 12M, the cyan unit 12C, the yellow unit 12Y and the black unit 12K. In order to ensure a high-quality image by suppressing the color drift, the meandering and shift of the transfer belt 125 need to be quickly corrected.

In this embodiment, in order to correct the meandering and shift of the transfer belt 125, the belt device 25 includes a belt sensor 32 for detecting the position of a belt end surface 31 of the transfer belt 125 in the belt width direction, a belt meandering correction roller for moving the transfer belt 125 in the belt width direction, a roller position adjusting mechanism 33 for moving the belt end surface 31 in the belt width direction by adjusting the position of the belt meandering correction roller, and a controller 34 for controlling the roller position adjusting mechanism 33 based on a detection signal of the belt sensor 32. In this embodiment, the driven roller 22 is employed as an example of the belt meandering correction roller.

Figure 5:
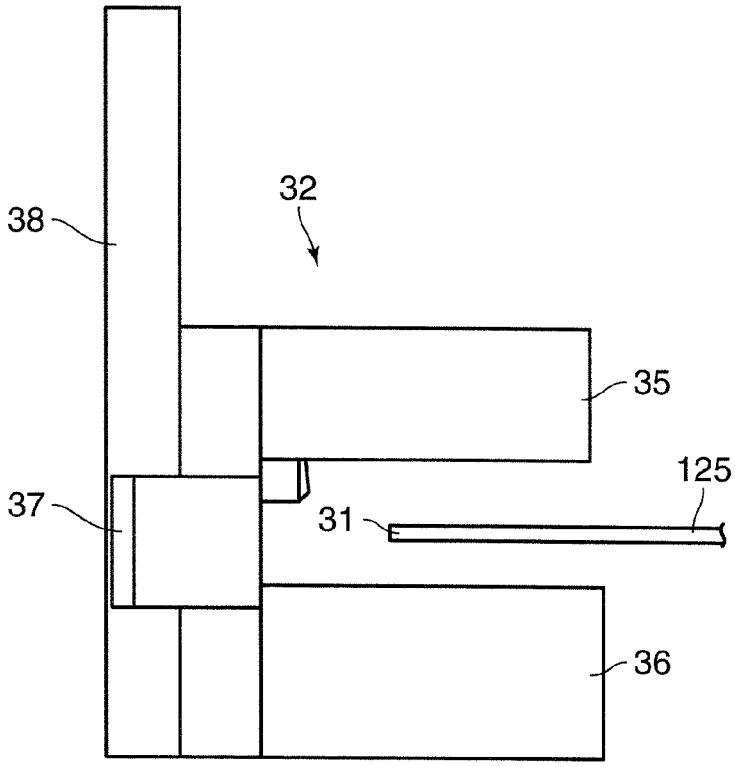
FIG. 5 is a side view showing the construction of a belt sensor of the belt device.

As shown in FIGS. 2 and 3, the belt sensor 32 is arranged between the drive roller 21 and the secondary-transfer opposed roller 125*c* on a rotation path of the transfer belt 125. As shown in FIG. 5, the belt sensor 32 includes a light emitting part 35 for irradiating light in a specified direction (downward in FIG. 5) and a light receiving part 36 arranged to face the light emitting part 35 for receiving the light. The belt sensor 32 is so arranged that the belt end surface 31 of the transfer belt 125 passes between the light emitting part 35 and the light receiving part 36. The belt sensor 32 is fixed to a supporting plate 37 and supported on a supporting frame 38 via the supporting plate 37.

Figure 6:
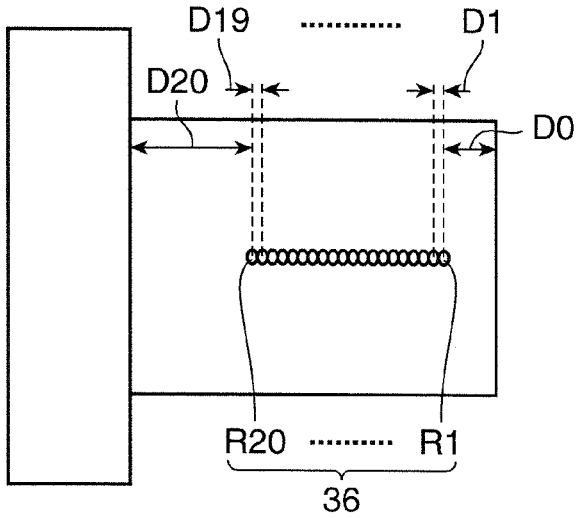
FIG. 6 is a schematic view showing an array of light emitting elements of a light receiving part of the belt sensor.

The belt sensor 32 has a sensor detection area divided into a plurality of zones adjacent in the belt width direction and detects the position of the belt end surface 31 in this sensor detection area. Specifically, in this embodiment, the light receiving part 36 of the belt sensor 32 includes a plurality of light emitting elements arranged adjacent to each other in the belt width direction, e.g. 20 light receiving elements R1 to R20 as shown in FIG. 6. Each of the light receiving elements R1 to R20 is so set as to have a light receiving range of at least 100 μm in the belt width direction. In other words, a sensor pitch is set at 100 μm in the belt width direction. The sensor detection area is divided into 21 detection zones D0 to D20 and has a light receiving range of 1.9 mm. In FIG. 6, the detection zone D0 has a range to the right of the center of the light receiving element R1; the detection zone D1 has a range from the center of the light receiving element R1 to that of the light receiving element R2; the detection zone D2 has a range from the center of the light receiving element R2 to that of the light receiving element R3; the detection zone D3 has a range from the center of the light receiving element R3 to that of the light receiving element R4; the detection zone D4 has a range from the center of the light receiving element R4 to that of the light receiving element R5; the detection zone D5 has a range from the center of the light receiving element R5 to that of the light receiving element R6; and the remaining detection zones D6 to D20 similarly have specified ranges. The detection zone D0 has a range to the left of the center of the light receiving element R20. The light receiving ranges of the respective light emitting elements and the number of the detection zones can be easily and arbitrarily set.

The light receiving elements R1 to R20 output voltage values (detection signals) corresponding to received light quantities upon receiving light from the corresponding light emitting elements. The magnitudes of the voltage values output by the light receiving elements R1 to R20 vary because the light receiving elements R1 to R20 are covered by the belt end surface 31 and the light from the light emitting part 35 is blocked, i.e. vary according to a light blocking quantity by the belt end surface 31.

The controller 34 receives and compares the voltage values output from the respective light receiving elements R1 to R20, thereby determining the position of the belt end surface 31. Specifically, the controller 34 determines that the belt end surface 31 is located in the detection zone D10 from the tenth light receiving element R10 to the eleventh light receiving element R11, for example, when the voltage values of the first to the tenth light receiving elements R1 to R10 from the right in FIG. 6 are equal to or below a threshold value (e.g. 2.5 V) and the voltage value of the eleventh light receiving elements R11 exceeds the threshold value.

The controller 34 determines the position of the belt end surface 31, for example, every time the transfer belt 125 makes one rotation. If determining that the position of the belt end surface 31 differs from that one rotation before, the controller 34 executes a control to correct the meandering or shift of the transfer belt 125 by controlling the roller position adjusting mechanism 33 and adjusting the position of the belt end surface 31. Prior to the description of the above control, the roller position adjusting mechanism 33 is described.

As described above, the roller position adjusting mechanism 33 is for moving the belt end surface 31 in the belt width direction by adjusting the position of the driven roller 22. The driven roller 22 is so constructed that the second rotary shaft 27 can be inclined with an unillustrated end portion of the second rotary shaft 27 as a base point to move an other end portion 39 thereof in a specified forward or reverse direction. By inclining the second rotary shaft 27 to move the other end portion 39, the transfer belt 125 mounted on the second roller body 26 of the driven roller 22 can be moved in the longitudinal direction of the driven roller 22. In other words, the belt end surface 31 can be moved in the belt width direction. By finely adjusting the inclination of the second rotary shaft 27, the belt end surface 31 is moved in a first direction or a second direction opposite to the first direction along the belt width direction.

The roller position adjusting mechanism 33 specifically includes a supporting frame 41 with a bearing 40 for rotatably supporting the second rotary shaft 27 of the driven roller 22, a pivot shaft 42 for pivotally supporting the supporting frame 41, a cam 43 for pivoting the supporting frame 41 about the pivot shaft 42, a gear 44 formed coaxially with and integrally to the cam 43 and a drive motor 46 with an output shaft engaged with the gear 44.

Figure 4:
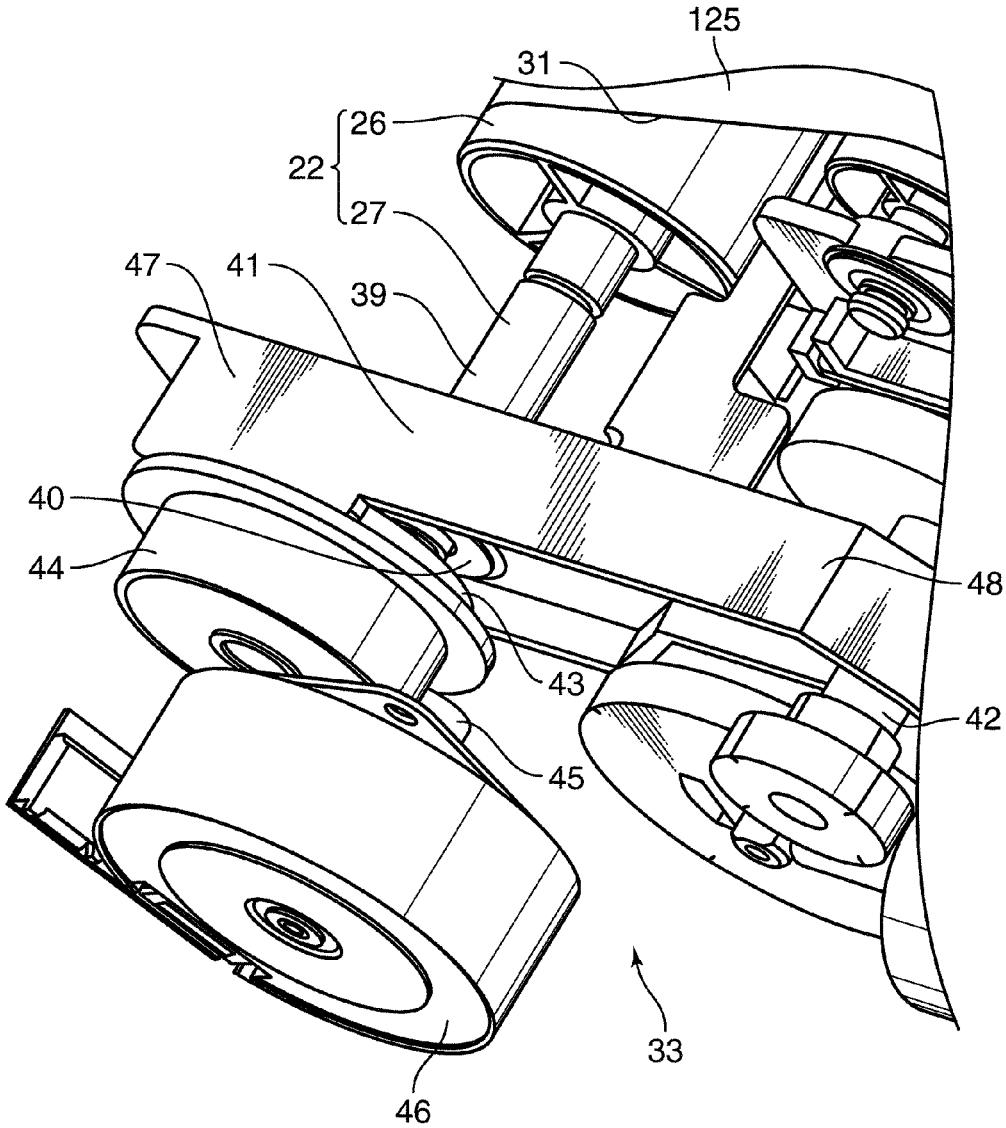
FIG. 4 is a perspective view showing a driven roller of the belt device and its periphery.

The supporting frame 41 is a member extending along the longitudinal direction of the transfer belt 125 at a position lateral to the transfer belt 125 and includes one end portion 47 having the bearing 40 and other end portion 48 where the pivot shaft 42 is provided. The cam 43 is positioned in contact with a specified contact portion of the one end portion 47 of the supporting frame 41. The supporting frame 41 shown in FIG. 4 is a frame supporting the other end portion 39 of the second rotary shaft 27 and the gear 44 is rotatably supported by an unillustrated supporting shaft.

The roller position adjusting mechanism 33 constructed as above moves the belt end surface 31 of the transfer belt 125 in the belt width direction as follows. In this embodiment, the drive motor 46 is a pulse motor and the controller 34 drives the drive motor 46 by a specified number of drive pulses. A drive force of the drive motor 46 is transmitted to the gear 44 via the output shaft 45, thereby rotating the gear 44. As the gear 44 rotates, the cam 43 formed integrally to the gear 44 pivots the one end portion 47 of the supporting frame 41 about the pivot shaft 42 while being held in contact with the contact portion of the one end portion 47 of the supporting frame 41. In this way, the other end portion 39 of the second rotary shaft 27 of the driven roller 22 supported by the bearing 40 inclines in the specified forward or reverse direction with the one end portion of the second rotary shaft 27 as the base point. Since an angle of inclination of the second rotary shaft 27 can be finely adjusted according to the number of drive pulses, the position of the belt end surface 31 of the transfer belt 125 in the belt width direction can be finely adjusted in the detection area of the belt sensor 32.

The control of the controller 34 to correct the meandering or shift of the transfer belt 125 based on a voltage value (detection signal) from the belt sensor 32 is described below. The meandering and shift of the transfer belt 125 can be corrected by executing a control to hold the belt end surface 31 at a specific position in the belt width direction. In this embodiment, the controller 34 suppresses the meandering and the shift of the transfer belt 125 by controlling the roller position adjusting mechanism 33 such that the belt end surface 31 of the transfer belt 125 constantly remains in one of the plurality of detection zones D1 to D19 of the belt sensor 32.

Controls by the controller 34 are conceptually roughly divided into first control patterns (FIGS. 7A and 7B) and second control patterns (FIGS. 8A and 8B) as shown in FIGS. 7A, 7B, 8A and 8B. In other words, in the first control patterns, when the belt end surface 31 moved, for example, from an arbitrary first detection zone to a second detection zone adjacent to the first detection zone out of a plurality of detection zones D1 to D19 of the belt sensor 32 (detection zones D0, D20 are not used in this embodiment), the controller 34 controls the roller position adjusting mechanism 33 to keep the belt end surface 31 in the second detection zone. In the second control patterns, when the belt end surface 31 moved from the first detection zone to the second detection zone, the controller 34 controls the roller position adjusting mechanism 33 to return the belt end surface 31 from the second detection zone to the first detection zone, i.e. to keep the belt end surface 31 in the initial detection zone. A symbol ○ in FIGS. 7A, 7B, 8A and 8B indicates the position of the belt end surface 31.

Figure 7A:
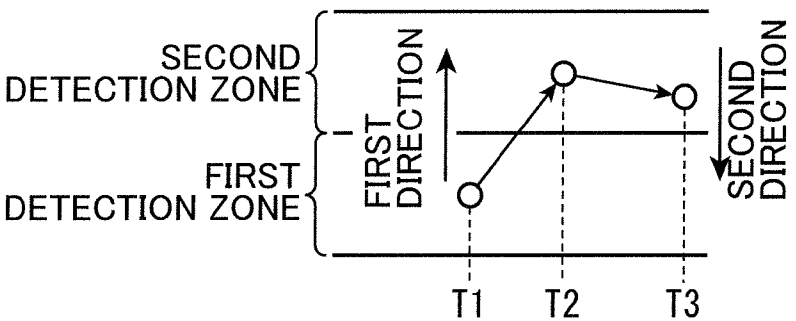
FIGS. 7A and 7B are diagrams conceptually showing a control by a controller.
Figure 7B:
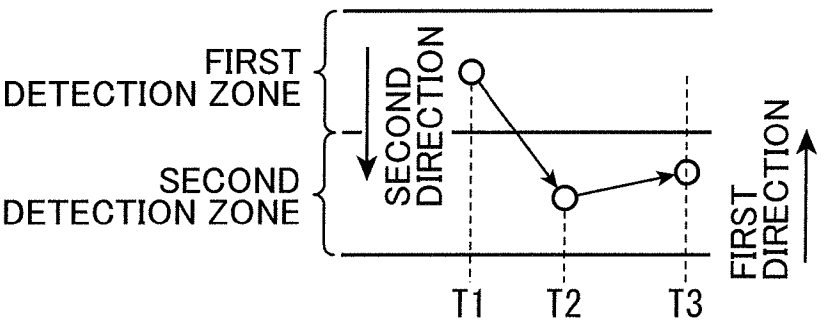
Figure 8A:
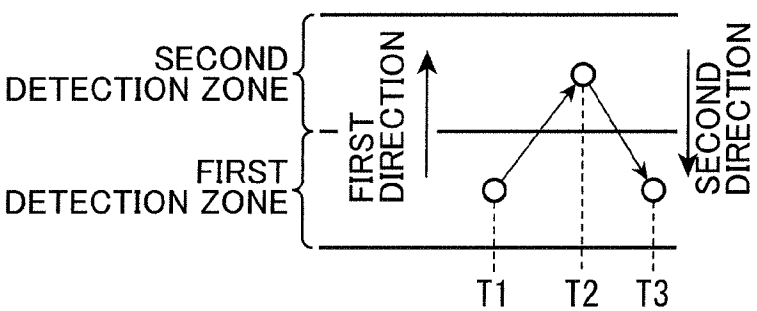
FIGS. 8A and 8B are diagrams conceptually showing another control by the controller.
Figure 8B:
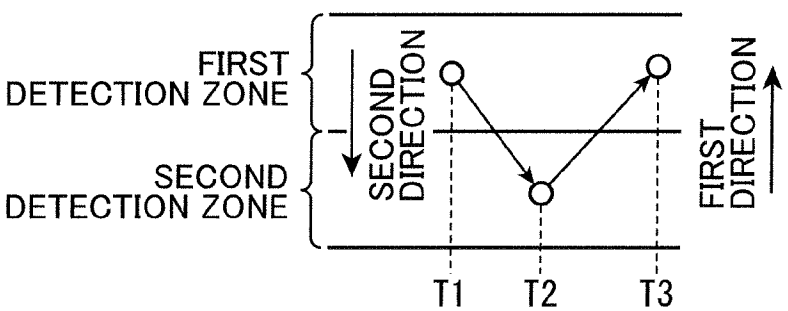

The belt end surface 31 is movable in the first or second direction along the belt width direction between the light emitting part 35 and the light receiving part 36 of the belt sensor 32 by the inclination of the driven roller 22 caused by the roller position adjusting mechanism 33. In FIGS. 7A, 7B, 8A and 8B, a moving direction of the belt end surface 31 from the first light receiving element R1 toward the twentieth light receiving element R20 from the right in the sensor detection area shown in FIG. 6 is referred to as the first direction and, conversely, a moving direction of the belt end surface 31 from the twentieth light receiving element R20 toward the first light receiving element R1 is referred to as the second direction for the description of the first control patterns (FIGS. 7A and 7B) and the second control patterns (FIGS. 8A and 8B).

First of all, the first control patterns are described with reference to FIGS. 7A and 7B. When it is determined that the belt end surface 31 moved from the first detection zone to the second detection zone from time T1 to time T2 by comparing the voltage values from the light receiving elements constituting the first detection zone and those from the light receiving elements constituting the second detection zone, the controller 34 inclines the second rotary shaft 27 of the driven roller 22 by a specified angle in a specified direction by means of the roller position adjusting mechanism 33 at time T2 if the belt end surface 31 moved from the first detection zone to the second detection zone in the first direction. Then, the belt end surface 31 moves only by a specified distance in the second direction in the second detection zone from time T2 to time T3 as shown in FIG. 7A. In this way, the belt end surface 31 can be kept in the second detection zone (first control). Since the meandering or shift of the transfer belt 125 occurs in such a manner as to move the belt end surface 31 in the first direction, it advances beyond the second detection zone to the third detection zone adjacent to the second detection zone unless the belt end surface 31 is moved by the specified distance in the second direction.

On the other hand, if the belt end surface 31 moved from the first detection zone to the second detection zone in the second direction, the controller 34 inclines the second rotary shaft 27 of the driven roller 22 by a specified angle in a direction opposite to the one during the first control at time T2 by means of the roller position adjusting mechanism 33. Then, the belt end surface 31 moves a specified distance in the first direction in the second detection zone from time T2 to time T3 as shown in FIG. 7B. In this way, the belt end surface 31 can be kept in the second detection zone (second control). Since the meandering or shift of the transfer belt 125 occurs in such a manner as to move the belt end surface 31 in the second direction, it advances beyond the second detection zone to the third detection zone unless the belt end surface 31 is moved by the specified distance in the first direction.

Next, the second control patterns are described with reference to FIGS. 8A and 8B. When it is detected that the belt end surface 31 moved from the first detection zone to the second detection zone from time T1 to time T2 by comparing the voltage values from the light receiving elements constituting the first detection zone and those from the light receiving elements constituting the second detection zone, the controller 34 inclines the second rotary shaft 27 of the driven roller 22 by a specified angle in a specified direction by means of the roller position adjusting mechanism 33 to move the belt end surface 31 in the second direction at time T2, thereby returning the belt end surface 31 to the first detection zone from time T2 to time T3 as shown in FIG. 8A, if the belt end surface 31 moved from the first detection zone to the second detection zone in the first direction. Since the meandering or shift of the transfer belt 125 occurs in such a manner as to move the belt end surface 31 in the first direction, it advances beyond the second detection zone to the third detection zone unless the belt end surface 31 is moved in the second direction.

On the other hand, if the belt end surface 31 moved from the first detection zone to the second detection zone in the second direction, the controller 34 inclines the second rotary shaft 27 of the driven roller 22 by a specified angle in a direction opposite to the one in the case shown in FIG. 8A by means of the roller position adjusting mechanism 33 to move the belt end surface 31 in the first direction at time T2, thereby returning the belt end surface 31 to the first detection zone from time T2 to time T3 as shown in FIG. 8B. Since the meandering or shift of the transfer belt 125 occurs in such a manner as to move the belt end surface 31 in the second direction, it advances beyond the second detection zone to the third detection zone unless the belt end surface 31 is moved in the first direction. T1, T2 and T3 in FIGS. 7A, 7B, 8A and 8B represent points of time of detection performed every time the transfer belt 125 makes one rotation. T1, T2 and T3 in FIGS. 7A and 7B are different from those in FIGS. 8A and 8B.

A specific control by the controller 34 is described below. As described above, the belt sensor 32 detects the position of the specified same part of the belt end surface 31 every time the transfer belt 125 makes one rotation. If the length of the transfer belt 125 is 800 mm and belt speed is 200 mm/sec, the belt sensor 32 detects the position of the same part of the belt end surface 31 every 4 seconds. In other words, a sampling interval of the belt end surface 31 is 4 seconds. The controller 34 adjusts the position of the belt end surface 31 in the belt width direction using the following conditional expressions (1) to (7) based on voltage values sent from the belt sensor 32 every 4 seconds.

$$x(t)=0,\ b(t)=b(t-1)+1,\ c(t)=c(t-1) \text{ when } a(t)-a(t-1)=0 \qquad \text{Conditional expression (1)}$$

$$x(t)=-25/b(t-1),\ b(t)=1,\ c(t)=x(t) \text{ when } a(t)-a(t-1)=1,\ c(t-1)\leqq 0 \qquad \text{Conditional expression (2)}$$

$$x(t)=-c(t-1)/(b(t-1)+1),\ b(t)=1,\ c(t)=x(t) \text{ when } a(t)-a(t-1)=1,\ c(t-1)>0 \qquad \text{Conditional expression (3)}$$

$$x(t)=-c(t-1)/(b(t-1)+1),\ b(t)=1,\ c(t)=x(t) \text{ when } a(t)-a(t-1)=-1,\ c(t-1)<0 \qquad \text{Conditional expression (4)}$$

$$x(t)=25/b(t-1),\ b(t)=1,\ c(t)=x(t) \text{ when } a(t)-a(t-1)=-1,\ c(t-1)\geqq 0 \qquad \text{Conditional expression (5)}$$

$$x(t)=-25\times(a(t)-a(t-1)-0.5),\ b(t)=1,\ c(t)=-25 \text{ when } a(t)-a(t-1)\geqq 2 \qquad \text{Conditional expression (6)}$$

$$x(t)=-25\times(a(t)-a(t-1)+0.5),\ b(t)=1,\ c(t)=25 \text{ when } a(t)-a(t-1)\leqq -2 \qquad \text{Conditional expression (7)}$$

a(t): represents sensor stage (0 to 20), i.e. the rightmost detection zone D0 to the leftmost twentieth detection zone D20 in FIG. 6. Each of the detection zones D1 to D19 has a detection range of 100 μm.

x(t) represents the number of pulses (alignment change motor input pulse number) input to the drive motor 46 to drive and rotate the drive motor 46 in a specified forward or reverse direction. Accordingly, a moving distance of the belt end surface 31 in the belt width direction (first or second direction) can be finely changed by finely adjusting the pulse number. ± signs in the conditional expressions (1) to (7) determine the rotating direction of the drive motor 46. For example, the sign is + when the drive motor 46 is rotated in the forward direction, and the belt end surface 31 moves in the first direction along the belt width direction at this time. On the other hand, the sign is − when the drive motor 46 is rotated in the reverse direction, and the belt end surface 31 moves in the second direction along the belt width direction at this time.

b(t) represents the number of times (sampling number) the belt sensor 32 has detected the position of the belt end surface 31 after the drive motor 46 is driven last time, i.e. represents elapsed time after the last change of the position of the belt end surface 31 since the detection interval by the belt sensor 32 is 4 seconds.

c(t) represents the number of pulses input when the drive motor 46 is driven last time. Upon setting the above conditional expressions (1) to (7), a relationship of the input pulse number x(t) and a belt shifting speed v(t) are so set as to satisfy: x(t)(pulse)≈v(t+1)(μm/sec)−v(t)(μm/sec). Here, the belt shifting speed means a moving speed of the belt end surface 31 in the belt width direction every time the transfer belt 125 makes one rotation. Since the sampling interval is 4 seconds, the belt shifting speed is calculated by (belt end surface position in the present sampling—belt end surface position in one previous sampling) μm/4 sec.

The conditional expression (1) is the one applied when there is no change in the sensor stage, and the input pulse number x(t) is 0.

The conditional expressions (2) and (5) are those applied when the sensor stage changes by ±1 with the sampling number b(t−1) and, in this case, the input pulse number x(t) is set at −(±)25/b(t−1) since an average belt shifting speed is ±100 μm/4 sec/b(t−1).

The conditional expressions (3) and (4) are those applied when the average belt shifting speed cannot be calculated and, in this case, the input pulse number x(t) is set at −c(t−1)/(b(t−1)+1) from experimental results in order to zero the belt shifting speed. When the conditional expressions (3) and (4) are applied, it is good to input pulses in a direction opposite to that of input pulses inputted when the drive motor 46 is driven last time and also to decrease the absolute value of the input pulse number x(t) as the sampling number after the last driving of the drive motor 46 increases.

The conditional expressions (6) and (7) are those applied when the sensor stage changes by ±2 or more during one rotation of the belt. In this case, the average belt shifting speed is 100 μm/4 sec×(a(t)−a(t−1)). In view of a distribution of a(t)−a(t−1), the input pulse number x(t) is set at −25×(a(t)−a(t−1)−(±)0.5). If an actual shift amount of the belt end surface 31 is assumed to conform to a normal distribution centered at 0, when the actual shift amount of the belt end surface 31 is divided into certain sections, the distribution is higher at a side closer to 0 in each section and a sample mean in each section approximates to 0, wherefore only 0.5 is added to or subtracted from a(t)−a(t−1).

Figure 9:
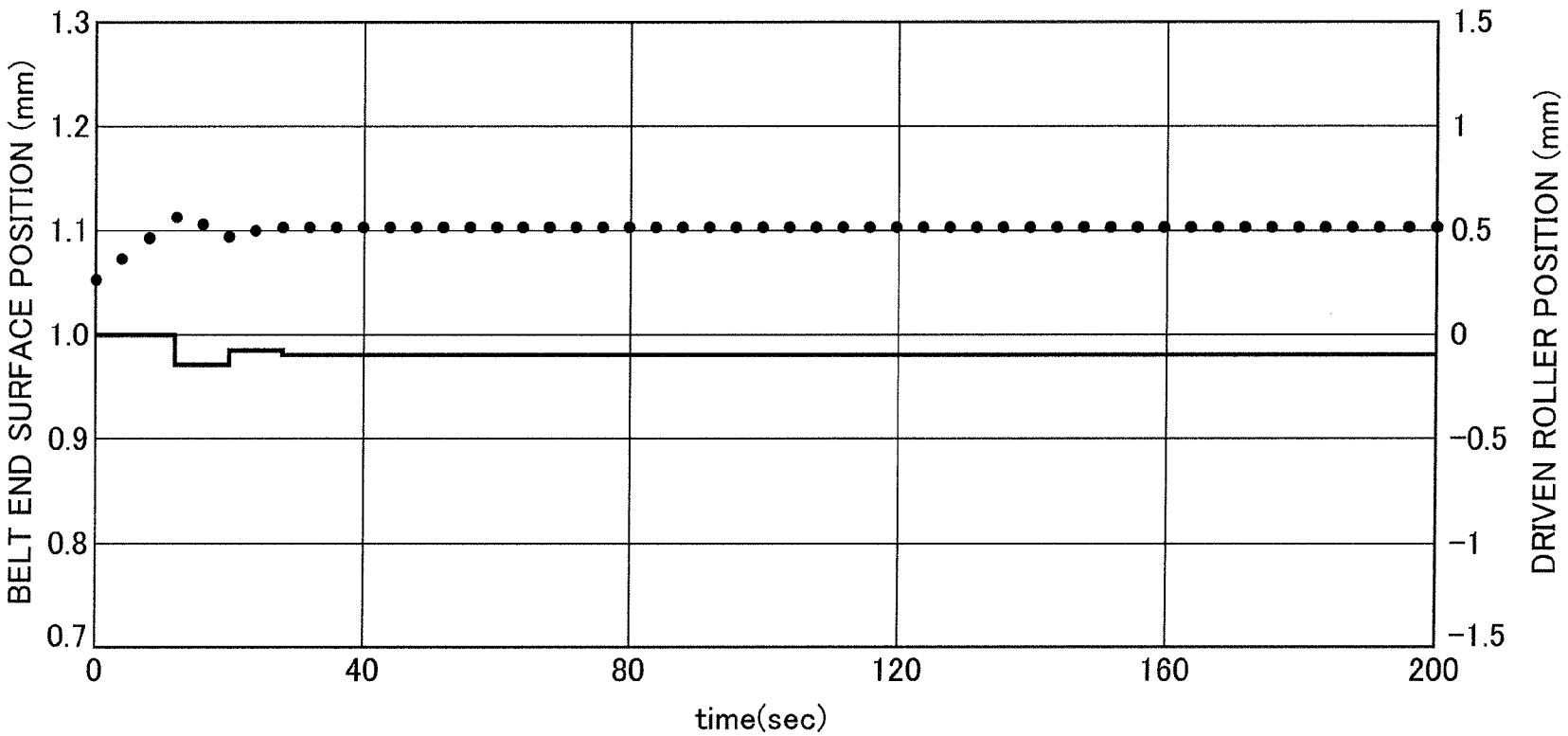
FIG. 9 is a graph showing a control example performed when a belt end surface moves from a tenth detection zone to an eleventh detection zone.

FIGS. 9 and 10 show a specific control example by the controller 34. In FIG. 9, a horizontal axis represents elapsed time and a left vertical axis represents the rightmost detection zone D0 to the leftmost twentieth detection zones D0 shown in FIG. 6. In FIG. 9, the seventh to thirteenth detection zones D7 to D13 are shown. Since each detection zone has the detection range of 100 μm in the belt width direction, the tenth detection zone D10 has the detection range from 1.0 mm to 1.1 mm from the detection zone D0 and the eleventh detection zone D11 has the range form 1.1 mm to 1.2 mm from the detection zone D0. On the other hand, a right vertical axis represents the position of the driven roller 22 from a reference position in mm. ● in FIG. 9 indicates the position of the belt end surface 31 at the time of sampling by the belt sensor 32. A solid line in FIG. 9 indicates a change in the position of the driven roller 22. FIG. 10 is a table showing the position of the belt end surface 31, a(t), x(t), b(t) and c(t) which changed with time.

The control example of FIG. 9 shows a control executed when the belt end surface 31 moves from the tenth detection zone D10 from the right in FIG. 6 to the eleventh detection zone D11, i.e. when the belt end surface 31 moves to the different and adjacent detection zone. In this control example, the controller 34 keeps the belt end surface 31 in the eleventh detection zone D11 by controlling the roller position adjusting mechanism 33 and adjusting the position of the belt end surface 31 in the belt width direction.

The control of keeping the belt end surface 31 in the eleventh detection zone D11 is described in detail below with reference to FIGS. 9 and 10. It should be noted that t=0 shown in FIGS. 9 and 10 indicates an arbitrary starting time when the detection by the belt sensor 32 is started upon the start of a new printing operation and b(t) (sampling number after the drive motor 46 is driven last time)=2 when t=0.

As shown in FIG. 9, the belt end surface 31 is located in the tenth detection zone D10 when t=8, but moves to the eleventh detection zone D11 when t=12. A moving distance of the belt end surface 31 from time t=0 to time t=12 is 1.110 mm−1.050 mm=0.060 mm and time required to move this distance is 12 seconds. Accordingly, a moving speed V1 of the belt end surface 31 from the tenth detection zone D10 to the eleventh detection zone D11 after the start of sampling is 0.060 mm/12 sec. Unless the position of the belt end surface 31 is adjusted by the controller 34, the belt end surface 31 is thought to continue to move at the speed V in the first direction in the eleventh detection zone D11 and move to the twelfth detection zone D12.

When judging based on the voltage values from the belt sensor 32 that the belt end surface 31 moved from the tenth detection zone D10 to the eleventh detection zone D11, the controller 34 calculates the input pulse number x(t) by applying the conditional expression (2) since a(t)−a(t−1)=1 and c(t−1) 0 at t=12. In this case, x(t)=−25/b(t−1)=−25/4=−6.25 and digital signals are used in the control of this embodiment. Thus, the input pulse number x(t) is dealt to be −7. When the controller 34 sends a pulse signal corresponding to the input pulse number x(t)=−7 to the drive motor 46 of the roller position adjusting mechanism 33, the drive motor 46 is rotated by an amount corresponding to the input pulse number x(t)=−7 to incline the second rotary shaft 27 of the driven roller 22, whereby the belt end surface 31 is moved by a specified distance in the second direction along the belt width direction. After t=12, the other end portion 39 of the second rotary shaft 27 of the driven roller 22 moves 0.14 mm in the second direction from the reference position. Thus, if the positions of the belt end surface 31 are connected, a movement path of the belt end surface 31 has a positive gradient up to t=12, but its gradient is changed to a negative one after t=12.

By moving the belt end surface 31 by the specified distance in the second direction after t=12 in this way, the controller 34 keeps in the eleventh detection zone D11 the belt end surface 31 which is trying to move to the twelfth detection zone D12 by moving in the first direction. This suppresses a movement of the belt end surface 31 in the belt width direction, i.e. the meandering or shift of the transfer belt 125. As a result, the color drift of the color toner image is suppressed, thereby making it possible to form a high-quality color toner image.

However, if the input pulse number x(t) (x(t)=−7 at t=12 in this case) for moving the belt end surface 31 in the second direction is excessively large, i.e. if the inclination of the driven roller 22 is excessively large, the belt end surface 31 may return from the eleventh detection zone D11 to the initial tenth detection zone D10 at t=20 as shown in FIG. 9. If the belt end surface 31 returns to the initial tenth detection zone D10 in this way and continues to move in the second direction, it may cause the transfer belt 125 to meander or to be shifted toward one side. Therefore, it becomes difficult to form a high-quality color toner image.

In such a case, when judging based on the voltage values from the belt sensor 32 that the belt end surface 31 returned from the eleventh detection zone D11 to the tenth detection zone D10, the controller 34 calculates the input pulse number x(t) by applying the conditional expression (4) since a(t)−a(t−1)=−1 and c(t−1)<0 at t=20. In this case, x(t)=−c(t−1)/(b(t−1)+1)=−(−7)/(2+1)=2.3 and the input pulse number x(t) is dealt to be +3. When the controller 34 sends a pulse signal corresponding to the input pulse number x(t)=+3 to the drive motor 46, the drive motor 46 is rotated by an amount corresponding to the input pulse number x(t)=+3 to incline the driven roller 22, whereby the belt end surface 31 is moved in the first direction. After t=20, the other end portion 39 of the driven roller 22 moves 0.08 mm in the second direction from the reference position. Thus, the belt end surface 31 having temporarily returned to the tenth detection zone D10 from the eleventh detection zone D11 moves to the eleventh detection zone D11 at t=28 as shown in FIG. 9. As described above, the controller 34 executes a control to return the belt end surface 31 to the eleventh detection zone D11 even if the belt end surface 31 moves to the tenth detection zone D10 from the eleventh detection zone D11.

If the positions of the belt end surface 31 are connected in FIG. 9, a movement path of the belt end surface 31 has a negative gradient up to t=20, but its gradient is changed to a positive one after t=20. Since the pulse number x(t)=+3 input at t=20 is smaller than the pulse number x(t)=−7 input at t=12, the positive gradient of the belt end surface 31 after t=20 is smaller than the negative gradient of the belt end surface 31 from t=12 to t=20. In other words, a moving distance of the belt end surface 31 in the belt width direction after t=20 is shorter than the moving distance of the belt end surface 31 in the belt width direction after t=12 when viewed in each sampling by the belt sensor 32. Thus, it takes 8 seconds for the belt end surface 31 to move from the tenth detection zone D10 to the eleventh detection zone D11 in the belt width direction after t=20 and the belt end surface 31 having returned to the eleventh detection zone D11 slowly moves in the first direction in the eleventh detection zone D11.

Since the belt end surface 31 slowly moving with a gradient based on x(t)=+3 in the eleventh detection zone D11 by the control executed after t=20 remains for a longer time in the eleventh detection zone D11, it takes longer time for the belt end surface 31 to move to the twelfth detection zone D12. Since degrees of the meandering or shift of the transfer belt 125 can be reduced by that much, the travel of the transfer belt 125 becomes stable. As a result, image defects resulting from the color drift can be further suppressed.

In this embodiment, the controller 34 executes a control to further slow the moving speed of the belt end surface 31 in the eleventh detection zone D11 in order to make the travel of the transfer belt 125 more stable. The belt end surface 31 having moved to the eleventh detection zone D11 at t=28 continues to slowly move in the first direction in the eleventh detection zone D11 along the movement path with the positive gradient based on the input pulse number x(t)=+3, but the belt end surface 31 is thought to move to the twelfth detection zone D12 if continuing to move in the first direction.

Accordingly, when judging based on the voltage values from the belt sensor 32 that the belt end surface 31 moved from the tenth detection zone D10 to the eleventh detection zone D11, the controller 34 calculates the input pulse number x(t) by applying the conditional expression (3) since a(t)−a(t−1)=1 and c(t−1)>0 at t=28. In this case, x(t)=−c(t−1)/(b(t−1)+1)=−3/(2+1)=−1 and the input pulse number x(t) is dealt to be −1. When the controller 34 sends a pulse signal corresponding to the input pulse number x(t)=−1 to the drive motor 46, the drive motor 46 is rotated by an amount corresponding to the input pulse number x(t)=−1 to slightly incline the driven roller 22. After t=28, the other end portion 39 of the driven roller 22 moves 0.1 mm in the second direction from the reference position. Thus, the moving direction of the belt end surface 31 is changed from the first direction to the second direction.

However, since the input pulse number x(t)=−1 is too small to move the belt end surface 31 from the eleventh detection zone D11 to the tenth detection zone D10, the belt end surface 31 remains in the eleventh detection zone D11 near a boundary line between the eleventh and tenth detection zones D11 and D10 after t=28 as shown in FIG. 9. By the control executed at t=28, the belt end surface 31 remains near the boundary line (position of 1.102 mm) in the eleventh detection zone D11 also after t=28. This prevents the transfer belt 125 from meandering or being shifted, wherefore a high-quality color toner image can be formed.

As is clear from the above description, when the belt end surface 31 moves from the tenth detection zone D10 to the eleventh detection zone D11 due to the meandering or shift of the transfer belt 125, the controller 34 executes such a control that the movement path of the belt end surface 31 is zigzagged with respect to the boundary line so that the belt end surface 31 remains near the boundary line in the eleventh detection zone D11 in this embodiment if a point of 1.1 mm is the boundary line between the tenth and eleventh detection zones D10 and D11.

From the above description, it can be understood that the controller 34 executes a control to set an adjacent detection zone (eleventh detection zone D11 in this case) as a reference position for the belt end surface 31 every time the belt end surface 31 moves to the adjacent detection zone (eleventh detection zone D11) due to the meandering or shift of the transfer belt 125 and to keep the belt end surface 31 in the adjacent detection zone, instead of executing a conventional control to set a reference position for the belt end surface 31 in the belt width direction and to bring the belt end surface 31 to the reference position. Thus, the controller 34 can quickly correct the meandering or shift of the transfer belt 125 as compared with the conventional construction in which the control is continued until the belt end surface 31 is brought to the reference position.

Figure 11:
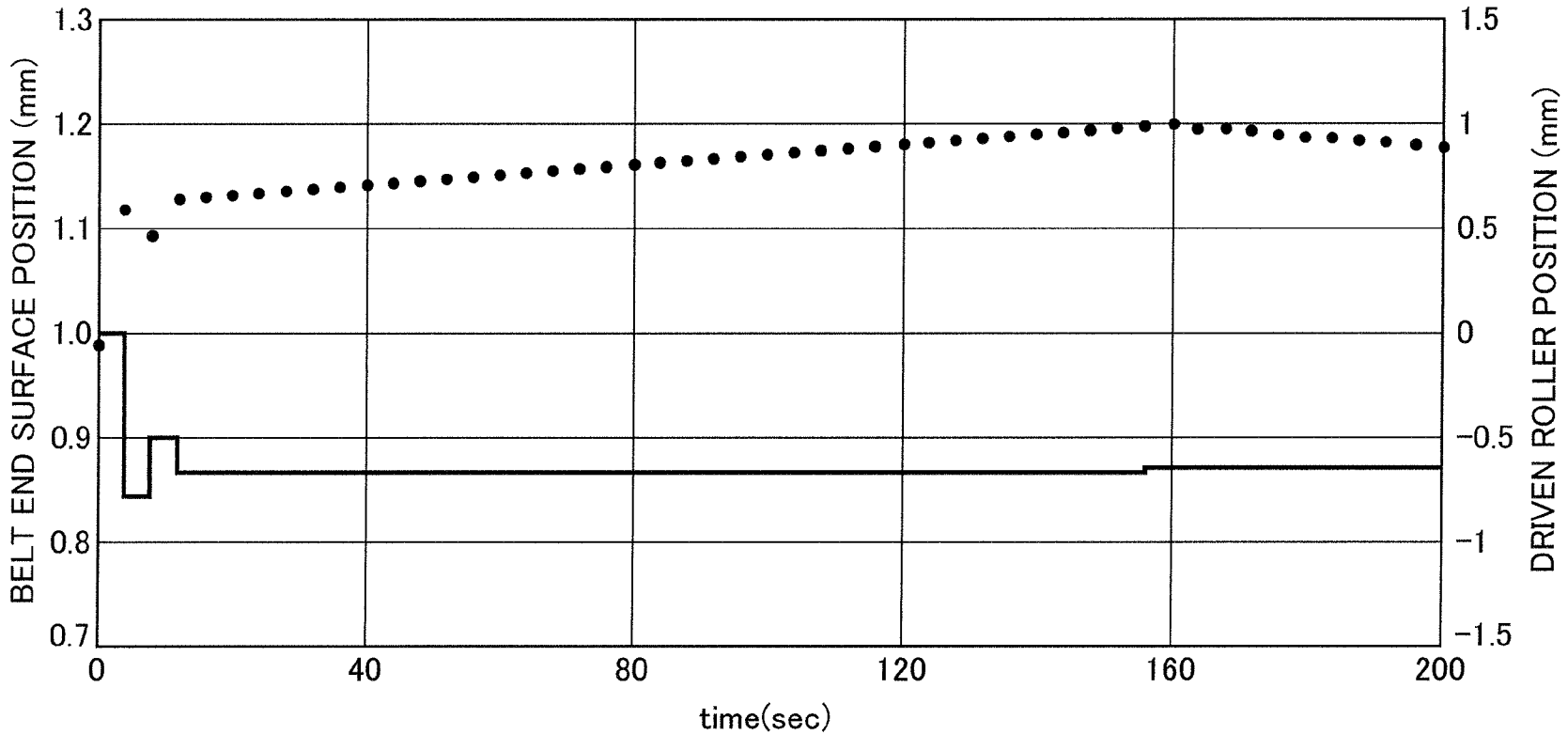
FIG. 11 is a graph showing a control example performed when the belt end surface moves from a ninth detection zone to the eleventh detection zone.

Next, another control example by the controller 34 is described with reference to FIGS. 11 and 12. FIG. 11 shows the control example to keep the belt end surface 31 in the eleventh detection zone D11, for example, when the belt end surface 31 moves from the ninth detection zone D9 to the eleventh detection zone D11 due to the meandering or shift of the transfer belt 125, i.e. when the belt end surface 31 moves to a further detection zone beyond an adjacent detection zone. The transfer belt 125 may largely meander or may be largely shifted toward one side in this way and, in such a case, the position of the belt end surface 31 in the belt width direction largely moves.

The belt end surface 31 located in the ninth detection zone D9 at t=0 moved to the eleventh detection zone D11 beyond the tenth detection zone D10 at t=4 due to the meandering or shift of the transfer belt 125. Since the belt end surface 31 moved to the eleventh detection zone D11 in the first direction, it may possibly move to the twelfth detection zone D12 if continuing to move in the first direction. Accordingly, when judging from the voltage values from the belt sensor 32 that the belt end surface 31 moved from the ninth detection zone D9 to the eleventh detection zone D11, the controller 34 calculates the input pulse number x(t) by applying the conditional expression (6) since a(t)−a(t−1)=≧2 at t=4. In this case, x(t)=−25×((a(t)−a(t−1)−0.5)=−25×(2−0.5)=−37.5 and the input pulse number x(t) is dealt to be −38 since digital signals are used in the control of this embodiment.

When the controller 34 sends a pulse signal corresponding to the input pulse number x(t)=−38 to the drive motor 46, the drive motor 46 is rotated by an amount corresponding to the input pulse number x(t)=−38 to incline the driven roller 22, whereby belt end surface 31 is moved in the second direction. After t=4, the other end portion 39 of the driven roller 22 moves 0.76 mm in the second direction from the reference position. Thus, if the positions of the belt end surface 31 are connected in FIG. 11, the movement path of the belt end surface 31 has a positive gradient up to t=4, but its gradient is changed to a negative one after t=4.

In this way, the controller 34 can change the moving direction of the belt end surface 31 from the first direction to the second direction by changing the gradient of the movement path of the belt end surface 31 to the negative one after t=4. This enables the belt end surface 31, which is moving in the first direction and trying to move to the twelfth detection zone D12, to remain in the eleventh detection zone D11. As a result, the meandering or shift of the transfer belt 125 is suppressed, wherefore a high-quality color toner image can be formed.

However, if the input pulse number x(t) (x(t)=−38 at t=4 in this case) for moving the belt end surface 31 in the second direction is excessively large, the belt end surface 31 may move from the eleventh detection zone D11 to the tenth detection zone D10 at t=8 as shown in FIG. 11. If the belt end surface 31 moves to the tenth detection zone D10 in this way and continues to move in the second direction, it may cause the transfer belt 125 to meander or to be shifted toward one side. Therefore, it becomes difficult to form a high-quality color toner image.

In such a case, when judging based on the voltage values from the belt sensor 32 that the belt end surface 31 moved from the eleventh detection zone D11 to the tenth detection zone D10, the controller 34 calculates the input pulse number x(t) by applying the conditional expression (4) since a(t)−a(t−1)=−1 and c(t−1)<0 at t=8. In this case, x(t)=−c(t−1)/(b(t−1)+1)=−(−25)/(1+1)=12.5 and the input pulse number x(t) is dealt to be +13.

When the controller 34 sends a pulse signal corresponding to the input pulse number x(t)=+13 to the drive motor 46, the drive motor 46 is rotated by an amount corresponding to the input pulse number x(t)=+13 to incline the driven roller 22, whereby the belt end surface 31 is moved in the first direction. After t=8, the other end portion 39 of the driven roller 22 moves 0.5 mm in the second direction from the reference position. Thus, the belt end surface 31 having moved to the tenth detection zone D10 returns to the eleventh detection zone D11 at t=12 as shown in FIG. 11. As described above, the controller 34 executes a control to return the belt end surface 31 to the eleventh detection zone D11 even if the belt end surface 31 moves to the tenth detection zone D10 from the eleventh detection zone D11. Thus, the meandering or shift of the transfer belt 125 can be quickly corrected.

In this embodiment, the controller 34 can execute a control to slow the moving speed of the belt end surface 31 in the eleventh detection zone D11 in order to make the travel of the transfer belt 125 stable. Since the input pulse number x(t)=13 set at t=8 is excessively large, the belt end surface 31 may possibly move to the twelfth detection zone D12 if continuing to move in the first direction based on the input pulse number x(t)=13. In order to prevent this, when judging from the voltage values from the belt sensor 32 at t=12 that the belt end surface 31 moved to the eleventh detection zone D11 from the tenth detection zone D10, the controller 34 calculates the input pulse number x(t) by applying the conditional expression (3) since a(t)−a(t−1)=1 and c(t−1)>0. In this case, x(t)=−c(t−1)/(b(t−1)+1)=−(13)/(1+1)=−6.5 and the input pulse number x(t) is dealt to be −7.

When the controller 34 sends a pulse signal corresponding to the input pulse number x(t)=−7 to the drive motor 46, the drive motor 46 is rotated by an amount corresponding to the input pulse number x(t)=−7 to incline the driven roller 22. After t=12, the other end portion 39 of the driven roller 22 moves 0.66 mm in the second direction from the reference position. Since the driven roller 22 is rotated in the negative direction, the belt end surface 31 is supposed to move in the second direction. However, in this case, a movement amount of the driven roller 22 is small and the belt end surface 31 continues to move in the first direction without moving in the second direction even if the driven roller 22 is rotated in the negative direction.

However, since the driven roller 22 is inclined in the negative direction based on the input pulse number x(t)=−7 at t=12, the moving distance of the belt end surface 31 in the first direction in each sampling can be reduced. As shown in FIG. 12, the moving distance of the belt end surface 31 in the first direction in each sampling after t=12 is only 0.002 mm. Since the belt end surface 31 slowly moves in the first direction in the eleventh detection zone D11 in this way, the belt end surface 31 can be kept in the eleventh detection zone D11 for a long time.

Although the belt end surface 31 remains in the eleventh detection zone D11 up to t=152, it moves to the twelfth detection zone D12 at t=156. When judging based on the voltage values from the belt sensor 32 that the belt end surface 31 moved from the eleventh detection zone D11 to the twelfth detection zone D12 at t=156, the controller 34 calculates the input pulse number x(t) by applying the conditional expression (2) since a(t)−a(t−1)=1 and c(t−1) 0. In this case, x(t)=−25/b(t−1)=−25/36=−0.694 and the input pulse number x(t) is dealt to be −1. The controller 34 sends a pulse signal corresponding to the input pulse number x(t)=−1 to the drive motor 46. Then, the drive motor 46 is rotated by an amount corresponding to the input pulse number x(t)=−1 to incline the driven roller 22 in the negative direction. In this way, the belt end surface 31 is moved in the second direction to return to the eleventh detection zone D11.

Since the controller 34 executes the control to constantly keep the belt end surface 31, which moved from the ninth detection zone D9 to the eleventh detection zone D11 due to the meandering or shift of the transfer belt 125, in the eleventh detection zone D11 in this way, the meandering or shift of the transfer belt 125 can be corrected. As a result, the color drift is suppressed and a high-quality color toner image can be formed.

As is clear from the first and second control patterns conceptually described with reference to FIGS. 7A, 7B and 8A, 8B, the control example specifically described with reference to FIGS. 9 and 10 and the other control example specifically described with reference to FIGS. 11 and 12, the controller 34 of the belt device 25 according to this embodiment controls the roller position adjusting mechanism 33 such that the belt end surface 31 is constantly kept in one of the first to nineteenth detection zones D1 to D19. The meandering and the shift of the transfer belt 125 can be quickly corrected by this construction, with the result that the color drift is suppressed and a high-quality color toner image can be formed.

The image forming apparatus, particularly the belt device used in the image forming apparatus according to this embodiment described above preferably has the following construction.

A belt device is provided with an endless belt, a plurality of rollers on which the belt is mounted and including a drive roller connected to a specified drive source and rotating the belt and a belt meandering correction roller correcting the meandering of the belt in a width direction of the belt, a sensor detecting the position of an end surface of the belt in a sensor detection area divided into a plurality of zones adjacent in the belt width direction, a roller position adjusting mechanism adjusting the position of the belt meandering correction roller to correct the meandering of the belt, and a controller controlling the roller position adjusting mechanism based on the position detection of the belt end surface by the sensor, the controller controlling the roller position adjusting mechanism to keep the belt end surface in a specific one of the plurality of zones.

According to the belt device constructed as above, since the belt end surface is controlled to be kept in the specific zone by the controller, the position of the belt end surface can be quickly corrected if being deviated from the specific zone. Accordingly, movements of the belt end surface in the belt width direction, i.e. the meandering and the shift of the belt can be suppressed. As a result, a high-quality image can be formed by suppressing the color drift of the image. The resolution of the control can be improved only by finely setting the zones. Since the control is merely executed to keep the belt end surface in the specific zone in the belt device according to the present invention as described above, the meandering and the shift of the belt can be quickly corrected as compared with the conventional construction for executing a control to set a specified reference position and bring a belt end surface to the reference position.

In the belt device constructed as above, when determining based on the detection of the sensor that the belt end surface moves from a first zone to a second zone in the plurality of zones, the controller controls the roller position adjusting mechanism to adjust the position of the belt meandering correction roller, thereby executing a control to keep the belt end surface in the second zone.

According to this construction, when it is detected by the sensor that the belt end surface moved from the first zone to the second zone due to the meandering or shift of the belt, the controller controls the roller position adjusting mechanism so that the belt end surface remains in the second zone other than controlling the roller position adjusting mechanism so that the belt end surface returns to the first zone as an initial zone. Even if the belt end surface moves from the first zone to the second zone, movements of the belt end surface in the belt width direction, i.e. the meandering and the shift of the belt can be suppressed by controlling the roller position adjusting mechanism so that the belt end surface remains in the second zone without permitting the belt end surface to move to a zone adjacent to the second zone, e.g. a third zone.

In the belt device constructed as above, it is preferable that the roller position adjusting mechanism moves the position of the belt end surface in a first direction or a second direction opposite to the first direction along the belt width direction through the belt meandering correction roller, and when determining based on the detection of the sensor that the belt end surface moves from the first zone to the second zone by moving in the first direction, the controller controls the roller position adjusting mechanism to move the belt end surface a specified distance in the second direction, thereby executing a first control to keep the position of the belt end surface in the second zone, on the other hand, when determining based on the detection of the sensor that the belt end surface moves from the first zone to the second zone by moving in the second direction, the controller controls the roller position adjusting mechanism to move the belt end surface a specified distance in the first direction, thereby executing a second control to keep the position of the belt end surface in the second zone.

In the belt device constructed as above, it is preferable that the plurality of zones have an equal and specified interval in the belt width direction, and if the belt end surface is in the first zone at a first point of time and moves from the first zone to the second zone at a second point of time, upon executing the first or second control, the controller first measures elapsed time from the first point of time to the second point of time, calculates a first gradient indicating a moving speed of the belt end surface from the first zone to the second zone by dividing the specified interval by the elapsed time and, then, if the first gradient when the belt end surface moves from the first zone to the second zone in the first direction is a positive gradient, controls the roller position adjusting mechanism to move the belt end surface in the second direction so that a second gradient indicating a moving speed of the belt end surface in the second zone after the second point of time becomes zero or negative. On the other hand, if the first gradient when the belt end surface moves from the first zone to the second zone in the second direction is a negative gradient, the controller controls the roller position adjusting mechanism to move the belt end surface in the first direction so that the second gradient indicating the moving speed of the belt end surface in the second zone after the second point of time becomes zero or positive.

In the belt device constructed as above, it is preferable that, when the belt end surface moves again from the second zone to the first zone in accordance with the second gradient after the second point of time, if a point of time at which the belt end surface moves again from the second zone to the first zone is defined as a third point of time. If the second gradient is a negative gradient, the controller first sets a third gradient indicating a moving speed of the belt end surface in the first zone after the third point of time to be a positive gradient and then controls the roller position adjusting mechanism to move the belt end surface from the first zone to the second zone. On the other hand, if the second gradient is a positive gradient, the controller first sets the third gradient indicating the moving speed of the belt end surface in the first zone after the third point of time to be a negative gradient and then controls the roller position adjusting mechanism to move the belt end surface from the first zone to the second zone.

In the belt device constructed as above, it is preferable that the sensor includes a light emitting part radiating light in a specified direction and a light receiving part receiving the light; that the light receiving part includes a plurality of light receiving elements arranged adjacent in the belt width direction; and that the plurality of zones are respectively defined between adjacent ones of the light receiving elements.

An image forming apparatus according to this embodiment is provided with a plurality of photosensitive drums each including a surface on which a color toner image of a corresponding color is to be formed; a belt device including an endless transfer belt to which the toner images are to be transferred from the photosensitive drums; a transfer unit transferring the toner images on the transfer belt to a sheet; and a fixing unit fixing the toner images on the sheet to the sheet, wherein the belt device constructed as above is employed as the belt device.

Since the image forming apparatus according to this embodiment employs the belt device constructed as above, color drift is suppressed even if color toner images are transferred to the transfer belt in a superimposition manner from the plurality of respective photosensitive drums. As a result, a high-quality color image can be formed.

This application is based on Japanese Patent application serial No. 2009-149891 filed in Japan Patent Office on Jun. 24, 2009, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A belt device, comprising:

an endless belt;

a plurality of rollers on which the belt is mounted and including a drive roller connected to a specified drive source and rotating the belt and a belt meandering correction roller correcting the meandering of the belt in a width direction of the belt;

a sensor detecting the position of an end surface of the belt in a sensor detection area divided into a plurality of zones adjacent in the belt width direction;

a roller position adjusting mechanism adjusting the position of the belt meandering correction roller to correct the meandering of the belt; and a controller controlling the roller position adjusting mechanism based on the position detection of the belt end surface by the sensor, wherein the roller position adjusting mechanism moves the position of the belt end surface in a first direction or a second direction opposite to the first direction along the belt width direction through the belt meandering correction roller;

the controller controls the roller position adjusting mechanism in such a manner that the roller position adjusting mechanism moves the belt end surface in the second direction after the belt end surface moves in the first direction to keep the belt end surface in a specific one of the plurality of zones.

2. A belt device according to claim 1, wherein, when determining based on the detection of the sensor that the belt end surface moves from a first zone to a second zone in the plurality of zones, the controller controls the roller position adjusting mechanism to adjust the position of the belt meandering correction roller, thereby executing a control to keep the belt end surface in the second zone.

3. A belt device according to claim 1, wherein: the sensor includes a light emitting part radiating light in a specified direction and a light receiving part receiving the light; the light receiving part includes a plurality of light receiving elements arranged adjacent in the belt width direction; and the plurality of zones are respectively defined between adjacent ones of the light receiving elements.

4. A belt device, comprising:

an endless belt;

a plurality of rollers on which the belt is mounted and including a drive roller connected to a specified drive source and rotating the belt and a belt meandering correction roller correcting the meandering of the belt in a width direction of the belt;

a sensor detecting the position of an end surface of the belt in a sensor detection area divided into a plurality of zones adjacent in the belt width direction;

a roller position adjusting mechanism adjusting the position of the belt meandering correction roller to correct the meandering of the belt; and a controller controlling the roller position adjusting mechanism based on the position detection of the belt end surface by the sensor, the controller controlling the roller position adjusting mechanism to keep the belt end surface in a specific one of the plurality of zones wherein:

the roller position adjusting mechanism moves the position of the belt end surface in a first direction or a second direction opposite to the first direction along the belt width direction through the belt meandering correction roller; and when determining based on the detection of the sensor that the belt end surface moves from a first zone to a second zone by moving in the first direction, the controller controls the roller position adjusting mechanism to move the belt end surface a specified distance in the second direction, thereby executing a first control to keep the position of the belt end surface in the second zone, on the other hand, when determining based on the detection of the sensor that the belt end surface moves into the second zone by moving in the second direction, the controller controls the roller position adjusting mechanism to move the belt end surface a specified distance in the first direction, thereby executing a second control to keep the position of the belt end surface in the second zone.

5. A belt device according to claim 4, wherein: the plurality of zones have an equal and specified interval in the belt width direction; and if the belt end surface is in the first zone at a first point of time and moves from the first zone to the second zone at a second point of time, upon executing the first or second control, the controller: first measures elapsed time from the first point of time to the second point of time, calculates a first gradient indicating a moving speed of the belt end surface from the first zone to the second zone by dividing the specified interval by the elapsed time and, then if the first gradient when the belt end surface moves from the first zone to the second zone in the first direction is a positive gradient, controls the roller position adjusting mechanism to move the belt end surface in the second direction so that a second gradient indicating a moving speed of the belt end surface in the second zone after the second point of time becomes zero or negative, on the other hand, if the first gradient when the belt end surface moves from the first zone to the second zone in the second direction is a negative gradient, controls the roller position adjusting mechanism to move the belt end surface in the first direction so that the second gradient indicating the moving speed of the belt end surface in the second zone after the second point of time becomes zero or positive.

6. A belt device according to claim 5, wherein: when the belt end surface moves again from the second zone to the first zone in accordance with the second gradient after the second point of time, if a point of time at which the belt end surface moves again from the second zone to the first zone is defined as a third point of time, if the second gradient is a negative gradient, the controller first sets a third gradient indicating a moving speed of the belt end surface in the first zone after the third point of time to be a positive gradient and then controls the roller position adjusting mechanism to move the belt end surface from the first zone to the second zone, on the other hand, if the second gradient is a positive gradient, the controller first sets the third gradient indicating the moving speed of the belt end surface in the first zone after the third point of time to be a negative gradient and then controls the roller position adjusting mechanism to move the belt end surface from the first zone to the second zone.

7. An image forming apparatus, comprising:

a plurality of photosensitive drums each including a surface on which a color toner image of a corresponding color is to be formed;

a belt device including an endless transfer belt to which the toner images are to be transferred from the photosensitive drums;

a transfer unit transferring the toner images on the transfer belt to a sheet; and a fixing unit fixing the toner images on the sheet to the sheet, wherein the belt device includes:

the endless belt;

a plurality of rollers on which the belt is mounted and including a drive roller connected to a specified drive source and rotating the belt and a belt meandering correction roller correcting the meandering of the belt in a width direction of the belt;

a sensor detecting the position of an end surface of the belt in a sensor detection area divided into a plurality of zones adjacent in the belt width direction;

a roller position adjusting mechanism adjusting the position of the belt meandering correction roller to correct the meandering of the belt; and a controller controlling the roller position adjusting mechanism based on the position detection of the belt end surface by the sensor, wherein the roller position adjusting mechanism moves the position of the belt end surface in a first direction or a second direction opposite to the first direction along the belt width direction through the belt meandering correction roller; and the controller controls the roller position adjusting mechanism in such a manner that the roller position adjusting mechanism moves the belt end surface in the second direction after the belt end surface moves in the first direction to keep the belt end surface in a specific one of the plurality of zones.

8. An image forming apparatus according to claim 7, wherein, when determining based on the detection of the sensor that the belt end surface moves from a first zone to a second zone in the plurality of zones, the controller controls the roller position adjusting mechanism to adjust the position of the belt meandering correction roller, thereby executing a control to keep the belt end surface in the second zone.

9. An image forming apparatus according to claim 7, wherein: the sensor includes a light emitting part radiating light in a specified direction and a light receiving part receiving the light; the light receiving part includes a plurality of light receiving elements arranged adjacent in the belt width direction; and the plurality of zones are respectively defined between adjacent ones of the light receiving elements.

10. An image forming apparatus, comprising:

a plurality of photosensitive drums each including a surface on which a color toner image of a corresponding color is to be formed;

a belt device including an endless transfer belt to which the toner images are to be transferred from the photosensitive drums;

a transfer unit transferring the toner images on the transfer belt to a sheet; and a fixing unit fixing the toner images on the sheet to the sheet, wherein the belt device includes:

the endless belt;

a plurality of rollers on which the belt is mounted and including a drive roller connected to a specified drive source and rotating the belt and a belt meandering correction roller correcting the meandering of the belt in a width direction of the belt;

a sensor detecting the position of an end surface of the belt in a sensor detection area divided into a plurality of zones adjacent in the belt width direction;

a roller position adjusting mechanism adjusting the position of the belt meandering correction roller to correct the meandering of the belt; and a controller controlling the roller position adjusting mechanism based on the position detection of the belt end surface by the sensor, the controller controlling the roller position adjusting mechanism to keep the belt end surface in a specific one of the plurality of zones; wherein:

the roller position adjusting mechanism moves the position of the belt end surface in a first direction or a second direction opposite to the first direction along the belt width direction through the belt meandering correction roller; and when determining based on the detection of the sensor that the belt end surface moves from a first zone to a the second zone by moving in the first direction, the controller controls the roller position adjusting mechanism to move the belt end surface a specified distance in the second direction, thereby executing a first control to keep the position of the belt end surface in the second zone, on the other hand, when determining based on the detection of the sensor that the belt end surface moves into the second zone by moving in the second direction, the controller controls the roller position adjusting mechanism to move the belt end surface a specified distance in the first direction, thereby executing a second control to keep the position of the belt end surface in the second zone.

11. An image forming apparatus according to claim 10, wherein: the plurality of zones have an equal and specified interval in the belt width direction; and if the belt end surface is in the first zone at a first point of time and moves from the first zone to the second zone at a second point of time, upon executing the first or second control, the controller: first measures elapsed time from the first point of time to the second point of time, calculates a first gradient indicating a moving speed of the belt end surface from the first zone to the second zone by dividing the specified interval by the elapsed time and, then if the first gradient when the belt end surface moves from the first zone to the second zone in the first direction is a positive gradient, controls the roller position adjusting mechanism to move the belt end surface in the second direction so that a second gradient indicating a moving speed of the belt end surface in the second zone after the second point of time becomes zero or negative, on the other hand, if the first gradient when the belt end surface moves from the first zone to the second zone in the second direction is a negative gradient, controls the roller position adjusting mechanism to move the belt end surface in the first direction so that the second gradient indicating the moving speed of the belt end surface in the second zone after the second point of time becomes zero or positive.

12. An image forming apparatus according to claim 11, wherein: when the belt end surface moves again from the second zone to the first zone in accordance with the second gradient after the second point of time, if a point of time at which the belt end surface moves again from the second zone to the first zone is defined as a third point of time, if the second gradient is a negative gradient, the controller first sets a third gradient indicating a moving speed of the belt end surface in the first zone after the third point of time to be a positive gradient and then controls the roller position adjusting mechanism to move the belt end surface from the first zone to the second zone, on the other hand, if the second gradient is a positive gradient, the controller first sets the third gradient indicating the moving speed of the belt end surface in the first zone after the third point of time to be a negative gradient and then controls the roller position adjusting mechanism to move the belt end surface from the first zone to the second zone.

* * * * *